US006237819B1

(12) United States Patent
Ramirez

(10) Patent No.: US 6,237,819 B1
(45) Date of Patent: May 29, 2001

(54) DECORATIVE BOW

(75) Inventor: James R. Ramirez, Kansas City, MO (US)

(73) Assignee: Hallmark Cards Incorporated, Kansas City, MO (US)

( * ) Notice: Subject to any disclaimer, the term of this patent is extended or adjusted under 35 U.S.C. 154(b) by 0 days.

(21) Appl. No.: 09/560,035

(22) Filed: Apr. 27, 2000

(51) Int. Cl.[7] ..... A41H 43/00
(52) U.S. Cl. ..... 223/46; 28/147; 428/4
(58) Field of Search ..... 223/46, 44; 28/147; 428/4

(56) References Cited

U.S. PATENT DOCUMENTS

| | | | | |
|---|---|---|---|---|
| D. 319,419 | | 8/1991 | Cheng | D11/184 |
| D. 330,876 | | 11/1992 | Huber | D11/141 |
| D. 387,396 | | 12/1997 | Chao | D21/91 |
| 395,953 | | 1/1889 | Clark . | |
| D. 411,137 | | 6/1999 | Goldstein | D11/184 |
| 664,743 | | 12/1900 | Hake . | |
| 2,164,966 | | 7/1939 | Tutein | 93/84 |
| 2,922,239 | | 1/1960 | Glynn, Jr. | 41/11 |
| 3,010,236 | * | 11/1961 | Doig | 428/369 |
| 3,061,153 | * | 10/1962 | Rector | 428/369 |
| 3,105,243 | | 10/1963 | Kampfe et al. | 2/244 |
| 3,150,576 | | 9/1964 | Gewiss | 93/84 |
| 3,973,513 | | 8/1976 | Huwe | 116/124 |
| 3,992,162 | | 11/1976 | Gewiss | 29/193.5 |
| 4,143,199 | * | 3/1979 | Bardon et al. | 428/369 |
| 4,201,806 | | 5/1980 | Cole | 428/4 |
| 4,291,496 | | 9/1981 | Click | 47/55 |
| 4,369,215 | | 1/1983 | Offen et al. | 428/4 |
| 4,418,103 | | 11/1983 | Tani et al. | 428/4 |
| 4,610,899 | | 9/1986 | Miller | 428/4 |
| 4,806,396 | | 2/1989 | Pratt et al. | 428/4 |
| 4,840,822 | | 6/1989 | Cheng | 428/4 |
| 4,968,540 | | 11/1990 | Linsenbigler | 428/5 |
| 4,981,732 | | 1/1991 | Hoberman | 428/12 |
| 5,079,046 | | 1/1992 | Kessler | 428/4 |
| 5,156,893 | | 10/1992 | Barthe | 428/4 |
| 5,233,132 | | 8/1993 | Soucille | 174/179 |
| 5,234,725 | | 8/1993 | Smith | 428/4 |
| 5,545,486 | | 8/1996 | Asano et al. | 428/542.8 |
| 5,897,926 | | 4/1999 | Mikulas | 428/17 |
| 5,903,926 | | 5/1999 | Fleming | 2/209 |
| 6,080,459 | * | 6/2000 | Keller | 428/43 |

FOREIGN PATENT DOCUMENTS

| | | |
|---|---|---|
| 10186 | 5/1901 | (GB) . |

* cited by examiner

*Primary Examiner*—Bibhu Mohanty
(74) *Attorney, Agent, or Firm*—Leydig, Voit & Mayer, Ltd.

(57) ABSTRACT

The decorative bow is provided which includes a plurality of ribbon-like strands that are folded in alternating directions to give the strand a zigzagging shape. The zigzagging strands of the decorative bow are held together at a common point with the ends of the strands running loose to provide a "cascading" look. This structure of the decorative bow can be used to provide many variations in the overall look by, for example, using ribbon materials with different colors and reflective effects or adjusting the lengths of the strands in the bow to give a layered appearance. The decorative bow may be secured to a base member (commonly called a "bow chip"), which may have a section for receiving printed indicia for display and an adhesive backing that allows the decorative bow to be attached easily to a desired object.

18 Claims, 5 Drawing Sheets

DECORATIVE BOW

TECHNICAL FIELD OF THE INVENTION

This invention relates generally to the art of decorating gift packages, gift bags and the like, and more particularly, this invention addresses the need to provide customers with alternatives to traditional forms of decorative articles such as bows that are used to prepare attractively wrapped packages by providing a new and unique decorative bow.

BACKGROUND OF THE INVENTION

Presenting gifts has always been a way for people to show affection, goodwill, friendship, etc. on various social occasions and events. To enhance the attractiveness of a gift, it is common to decorate the gift, such as by wrapping the gift with gift-wraps or placing the gifts in gift bags. Moreover, it is very common to further improve the visual appearance of the gift by attaching a decorative bow to the gift package.

There are various bow structures available for decorating gift bags and packages. Most of the decorative bows available on the market look more or less like a flower. For instance, a very common conventional structure of decorative bows consists of continuous strips of ribbon material twisted to form a succession of multiple loops radiating from a center. The loops of the bow structure may come in a variety of shapes, which provide subtle differences to the overall look of the bow. Regardless of such subtle variations, conventional decorative bows share a similar overall look and appearance.

In the art of decorating gift packages and bags, an interesting design of a decorative bow makes the gift to which it is attached stand out among other gifts. Moreover, consumers who are tired of the conventional look of decorative bows are often attracted to decorative bows that have more unique structures and interesting appearances. Thus, there is a need for a decorative bow that has a structure that is visually appealing and highly distinctive from the conventional flower-like decorative bows.

SUMMARY OF THE INVENTION

In view of the foregoing, the present invention provides a decorative bow that has an attractive appearance very distinct from that of conventional flower-like bows. The decorative bow of the invention includes a plurality of ribbon-like strands that are folded in a zigzagging manner. The zigzagging strands of decorative bow are held together at a common point to provide a "cascading" look that is very attractive and highly distinctive. This structure of the decorative bow can be used to provide many variations in the overall look. For example, varied looks can be achieved by using ribbon materials of various colors and surface finishes or other visual effects or by adjusting the lengths of the strands in the bow to give a layered appearance. The decorative bow may be secured to a base member (commonly called a "bow chip"), which may have provisions for printed indicia for display and an adhesive backing that allows the decorative bow to be attached easily to a desired object.

Additional features and advantages of the invention will be made apparent from the following detailed description of illustrative embodiments, which proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
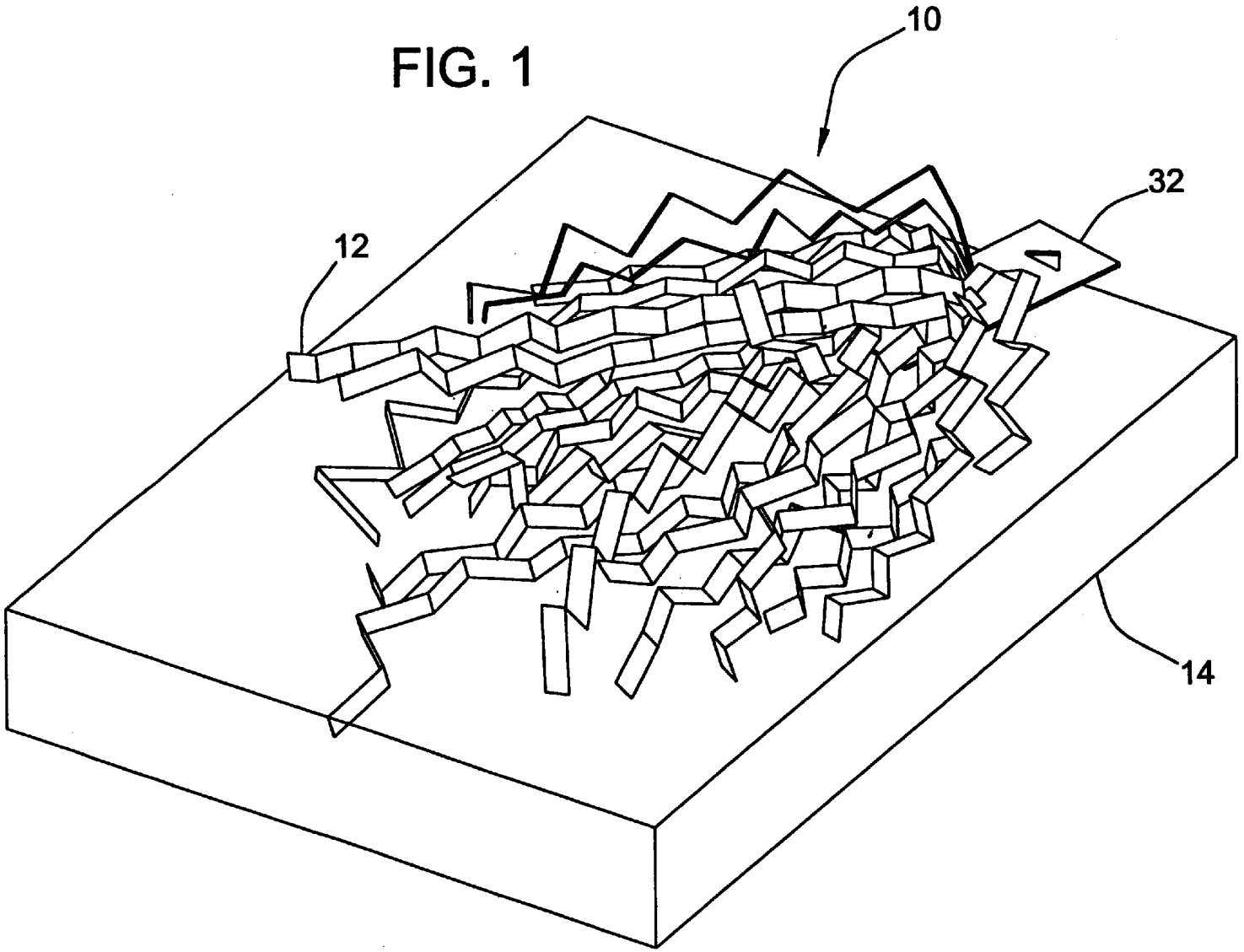
FIG. 1 is perspective view of an embodiment of a decorative bow of the invention, which has a plurality of ribbon-like strands folded in a zigzagging manner.

Turning to the drawings, the present invention provides a structure of a decorative bow that has an attractive appearance that is highly distinctive and quite different from the conventional flower-like decorative bows. As shown in the embodiment of FIG. 1, a decorative bow 10 in accordance with the invention has a plurality of ribbon-like strands 12. Each of the strands 12 has folds in alternating directions to shape the strand in a zigzagging manner. When grouped together, the zigzag ribbon-like strands 12 are naturally arranged in a semi-random flow that provides a unique "cascading" look. This decorative bow is highly suitable for use in decorating a gift package 14 or a gift bag, but can be attached to any other desirable object to make its appearance more interesting.

Figure 2:
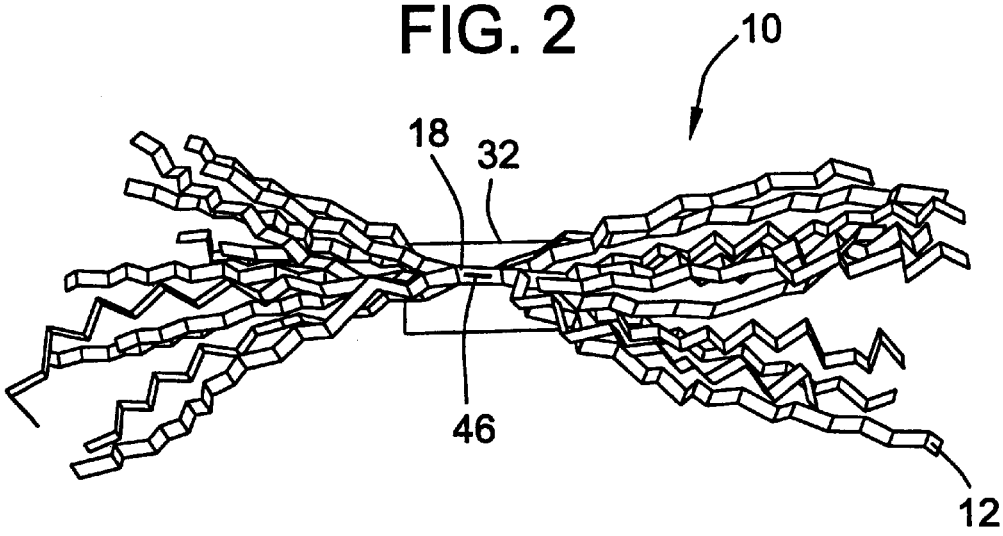
FIG. 2 is a top view of the decorative bow of FIG. 1 with the strands in an extended form.
Figure 3:
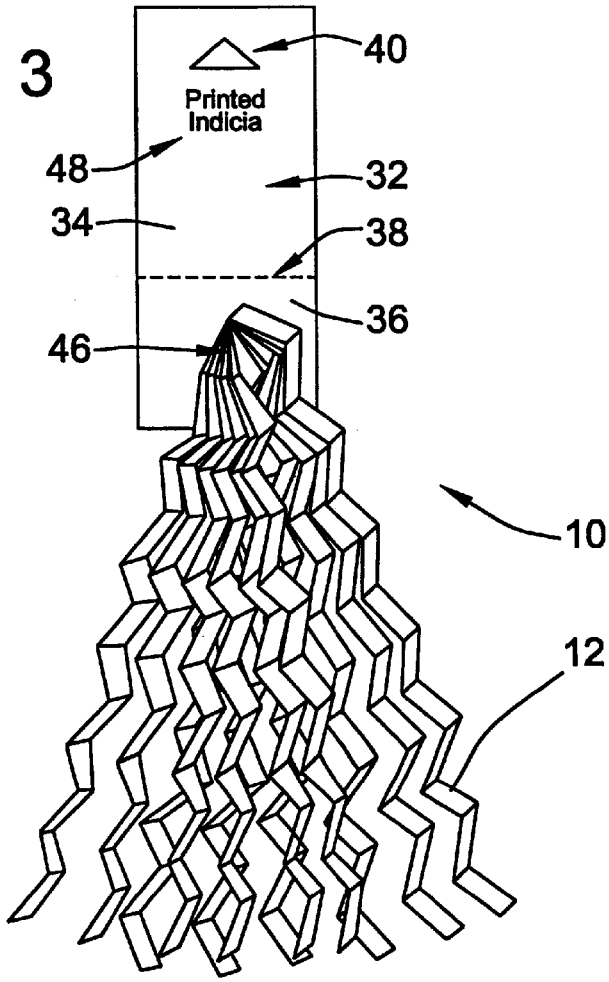
FIG. 3 is a top view of the decorative bow of FIG. 1 with the strands of the bow in a "doubled-up" shape.
Figure 4:
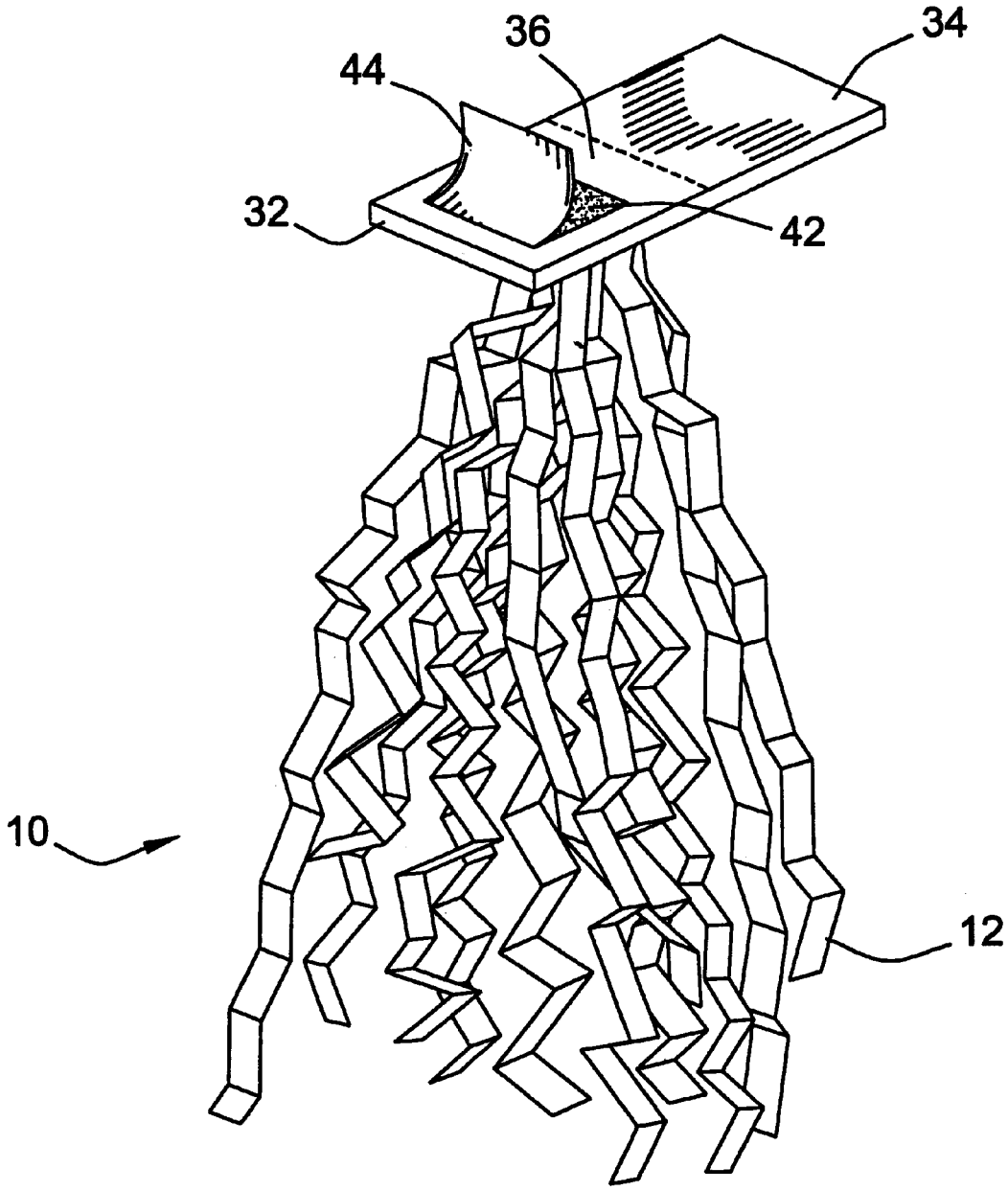
FIG. 4 is a side view of the decorative bow of FIG. 1 with the strands dangling downward.

One feature of the decorative bow is that the zigzagging strands are not fixed rigidly in a single position but are allowed to curve or move in response to different placement of the decorative bow. As a result, the overall shape of the decorative bow would depend on the way it is placed on the object to which it is attached. This freedom for the zigzagging strands to rearrange themselves gives the decorative bow an interesting free-flowing visual effect that is very different from the look of conventional ribbon bows, which are fixed in shape. FIGS. 2–4 illustrates the various positions the decorative bow may be placed. In general, the decorative bow preferably is attached to the top or side of the object being decorated such that the strands are in a "doubled-up" shape as shown in FIGS. 1 and 3.

Figure 5:
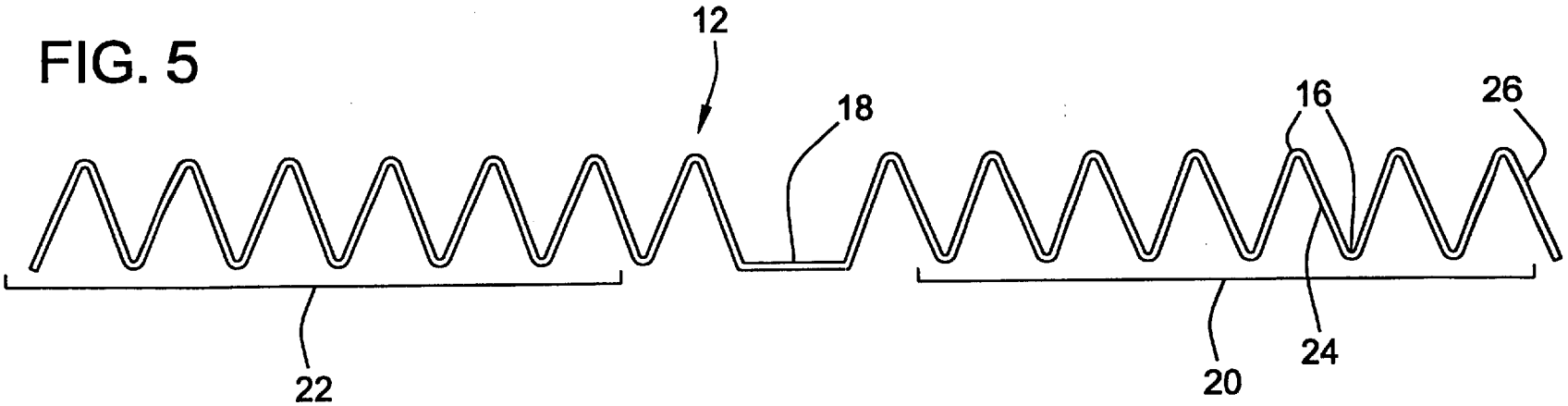
FIG. 5 is a side view of a strand of the decorative bow of FIG. 1.
Figure 6:
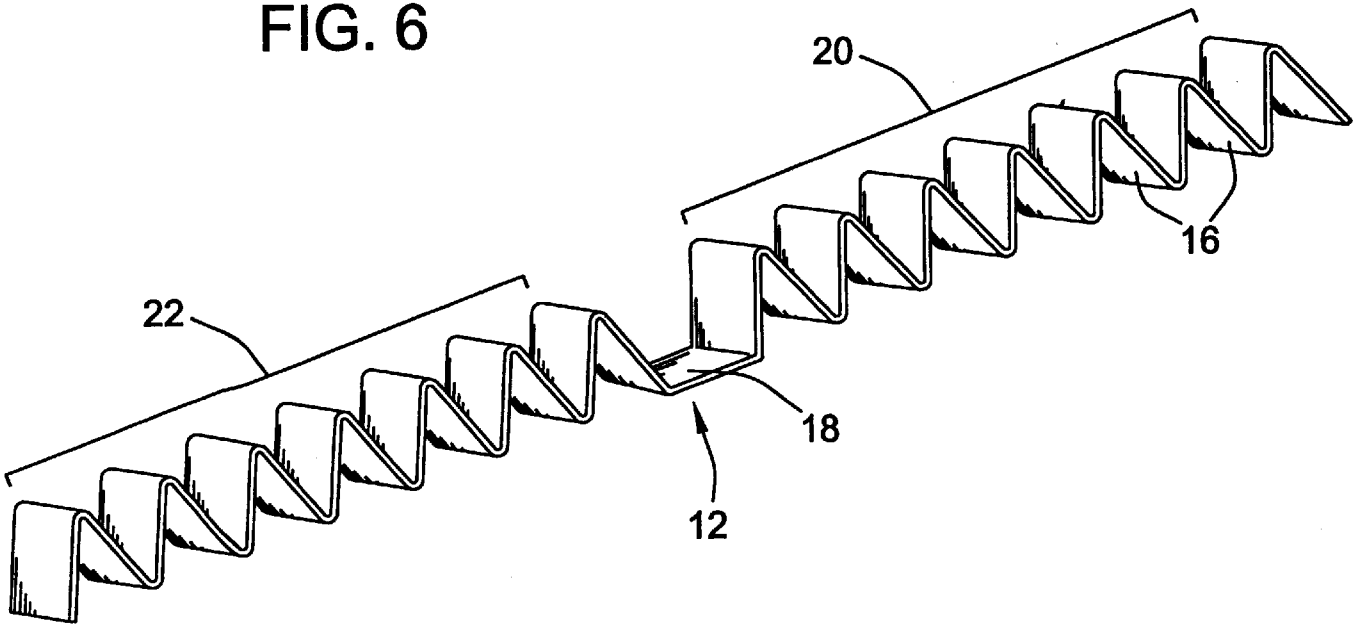
FIG. 6 is a perspective view of the strand of FIG. 5.

As can be best seen in FIGS. 5 and 6, each of strands 12 in the decorative bow is ribbon-like in that its width is significantly greater than its thickness. The strand 12 has a plurality of folds 16 across its width. The folds 16 are distributed along the length of the strand 10 and are in alternating directions to provide the zigzagging shape of the strand. In the illustrated embodiment, the strand has a center gathering section 18 that is generally flat (or not pleated), with the two side sections 20, 22 folded in the zigzagging manner. This center section is used to secure the strand with other strands of the bow, as will be described in greater detail below.

The zigzag segment length, i.e., the length of a segment 24 of the strand between two consecutive folds 16 on the two side sections of the strand may vary depending on parameters such as the length, width or stiffness of the strand, but preferably is in the range of from 0.5 inch to 1 inch. Depending on the type of ribbon material used to form the strands, the thickness of the strands may vary but preferably range from about 0.003 inch (3 mil) to about 0.006 inch (6 mil).

In the illustrated embodiment, the strand has a substantially uniform zigzag segment length. Variable zigzag segment lengths, however, may be used on one strand to provide a different visual effect. For example, the segment length may increase gradually with the distance from the center gathering section 18 to enhance the cascading look of the decorative bow. As another example, in an embodiment that will be described in greater detail below, strands of different overall lengths are combined to provide a layered look.

The strand 12 may be made of various synthetic and natural materials. For example, the strand may be cut from a sheet of polypropylene material. Alternatively, the strand may be cut from a spool of pre-formed ribbon. Moreover, the strand 12 does not have to be made of a single material but may be formed of laminated layers. For instance, the surface 26 of one or both sides of the strand may be a layer of metalized polypropylene film to provide a shiny or reflective surface. Alternatively, various surface treatments, such as painting or attachment of shiny sprinkles, can be applied to the strand to alter its appearance.

In a preferred embodiment, the decorative bow 10 includes a base member 32, which is commonly referred to as a "bow chip." The base member 32 in this embodiment serves several functions. First, as illustrated in FIG. 2, the base member 32 is a support member to which the plurality of zigzagging ribbon-like strands are secured. Second, the base member 32 may include means for attaching the decorative bow to a desired object. Third, the base member 32 may provide a surface on which various indicia can be printed or otherwise formed thereon such as product code and pricing information. Fourth, the base member may also be used to provide means for displaying the decorative bow in a store.

As shown in FIG. 3, the base member 32 preferably has a generally rectangular shape. The base member 32 may be made of paper stock or other suitable materials and preferably includes at least two sections. The first section 34 provides a surface area on which various indicia may be printed or otherwise formed. The indicia 48 may include, for example, text or graphics identifying the product and the sales price and the manufacturer of the product. The second section 36 of the base member 32 is where the zigzagging strands 12 of the decorative bow 10 are secured. The first section 34 also has an opening 40 that is formed, such as by die cutting, at a selected location. This opening 40 has a shape that allows the hanging of the decorative bow on commonly available display racks or other types of display devices at the point of purchase.

Because the purchaser of the decorative bow 10 may not want to include the first section 34 when the bow is attached to a gift, the base member 32 preferably has provisions to allow easy removal of the first section. In the illustrated embodiment, this is accomplished by separating the first and second sections 34 and 36 with a perforation line 38. A user of the decorative bow 10 may detach the first section 34 of the base member 32 from the bow by tearing along the perforation line 38. Alternatively, scored lines or other means may be used to allow easy separation of the two sections 34 and 36.

To allow the decorative bow 10 to be easily attached to a desired object, such as a wrapped gift, the base member 32 preferably has an adhesive layer 42 (FIG. 4) formed on the surface of the second section 36 opposite the zigzagging strands 12. The adhesive layer 42 is preferably covered by a removal backing 44 for protection thereof. To attach the bow 10 to an object such as a gift bag, the user tears off the first section 34 with printed indicia, peals off the protective backing 44 from the second section 36 as illustrated in FIG. 4, and presses the adhesive layer 42 against the object at a selected location.

There are many different ways to secure the strands 12 to the second section 36 of the base member 32, such as gluing, heat fusing, sewing, and stapling, etc. Stapling, however, is currently preferred due to its simplicity in application. It can be seen in the top view of FIG. 2 that a staple 46 is driven through the center gathering sections 18 of the plurality of zigzagging strands 12 to secure them to the base member 32.

Figure 7:
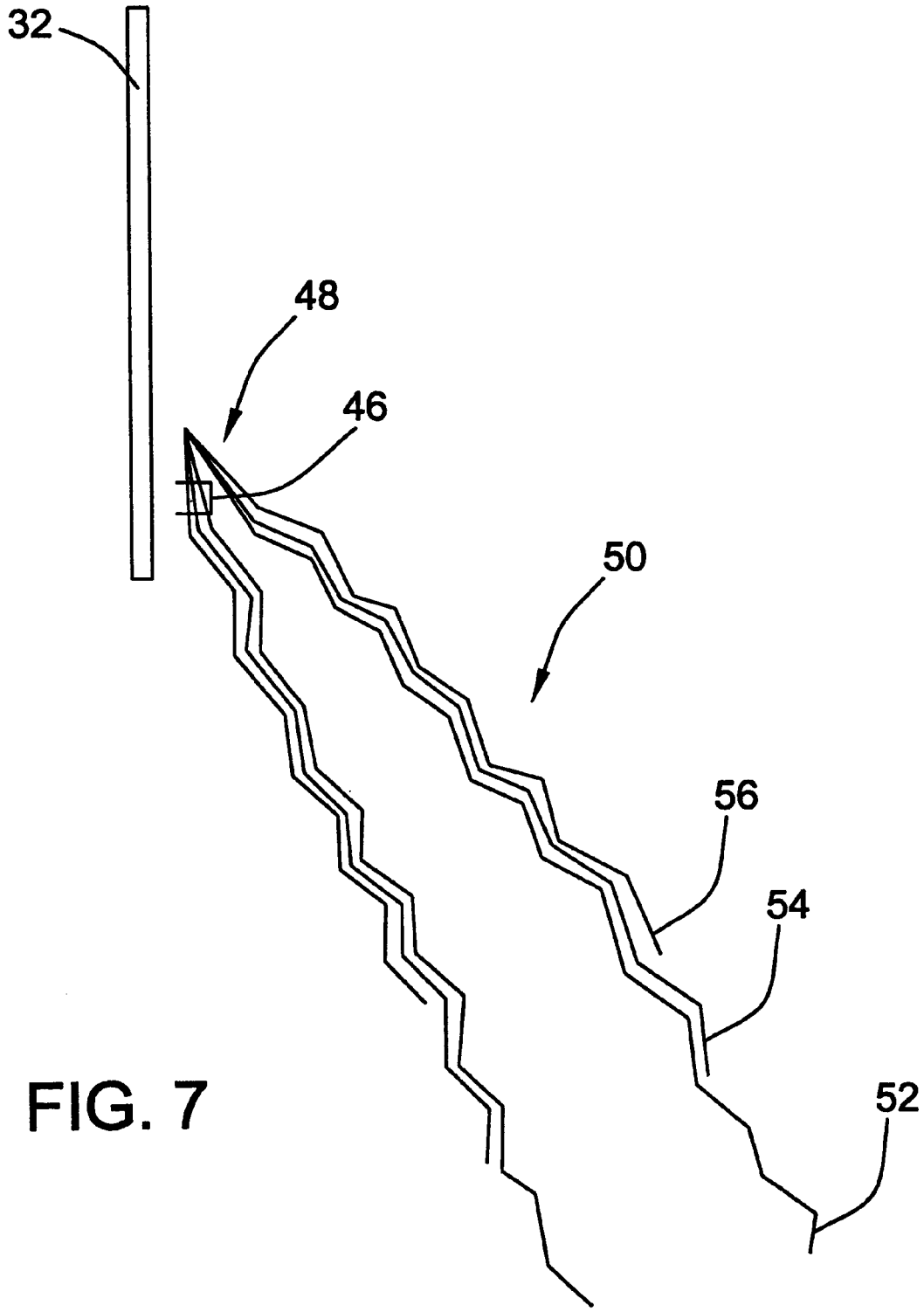
FIG. 7 is a schematic side view of another embodiment of decorative bow with zigzagging strands, wherein the strands have uneven lengths to provide a layered look.

As mentioned above, one embodiment of the decorative bow of the invention comprises multiple strands of varying lengths. By way of example, the following description describes a process for forming such a decorative bow. Referring to FIG. 7, in this specific example, the decorative bow 50 has eight (8) strands of a length of 18 inches, eight (8) strands of a length of 16 inches, and five (5) strands of a length of 14 inches. For simplicity and clarity of illustration, only one strand for each of the three lengths is shown in FIG. 7. Each of the strands 52, 54, 56 is about ¼ inches wide and is cut from a ribbon with a laminated layer that has a silvery-shiny surface of a selected color.

In the beginning of the process, the strands of the different lengths are provided. Each strand is folded in half. A mark is then made at a measured ¾ inch distance from the fold. A pleating step is then performed in which the strand is folded in alternating directions based on the first ¾ inch measurement all the way to the ends of the strand to create the zigzagging shape. A paper clip may then be placed over the pleated strand to hold it in the zigzag form until all other strands are likewise pleated. In this pleating process, it is important not to mix the strands with different lengths.

After all the strands are pleated, the paper clips may be removed from the strands. The center section of each strand is located, and the strands are stacked together. First, the 18-inch strands 52 are stacked one on top of the other. The 16-in strands 54 are then stacked over the 18-inch strands. The 14-inch strands 56 are then stacked over the 16-inch strands. The stacked strands are secured to a base member 32 by a staple 46 at the flat center sections just under the center point 48. Finally, the zigzagging strands are fanned out, and the decorative bow is completed. This process for forming the decorative bow 50 may be performed manually, but may also be performed by properly implemented machinery.

In view of the many possible embodiments to which the principles of this invention may be applied, it should be recognized that the embodiment described herein with respect to the drawing figures is meant to be illustrative only and should not be taken as limiting the scope of invention.

What is claimed is:

1. A decorative bow comprising:

a plurality of ribbon-like strands, each of the strands having a zigzag shape with a plurality of folds in regularly alternating directions distributed along a length of said each strand;

a base member to which the plurality of strands are secured.

2. A decorative bow as in claim 1, wherein each of the strands has a zigzag segment length of about 0.5 inch to 1 inch.

3. A decorative bow as in claim 1, wherein the plurality of the strands have a substantially uniform length.

4. A decorative bow as in claim 1, wherein the plurality of strands are of different lengths.

5. A decorative bow as in claim 4, wherein the strands of each of the different lengths are stacked together to provide a layered appearance of the decorative bow.

6. A decorative bow as in claim 1, wherein each of the strands has a non-pleated center section and first and second side sections, each of the first and second side sections having a plurality of folds in alternating directions, and wherein the center sections of the strands are secured together to the base member.

7. A decorative bow as in claim 6, wherein the center sections of the strands are secured to the base member with a staple.

8. A decorative bow as in claim 1, wherein one or more of the strands is formed of a laminated layer having a shiny surface.

9. A decorative bow as in claim 1, wherein the base member has a first section having indicia printed thereon and a second section to which the strands are secured.

10. A decorative bow as in claim 9, wherein the first section of the base member further has an opening formed therein to allow hanging of the decorative bow for display.

11. A decorative bow as in claim 9, wherein the base member includes means for facilitating easy separation of the first and second sections.

12. A method of forming a decorative bow, comprising the steps of:

providing a plurality of ribbon-like strands;

folding each of the strands in regularly alternating directions to provide said each strand with a zigzag shape;

securing the plurality of strands to a base member.

13. A method as in claim 12, wherein each strand after the step of folding has a non-pleated center section and two side sections each having folds in alternating directions, and wherein the step of securing attaches the center sections of the strands together on the base member.

14. A method as in claim 13, wherein the step of securing comprises stapling the center sections of the strands onto the base member.

15. A method as in claim 14, wherein the step of securing includes stacking the center sections of the folded strands prior to stapling to the base member.

16. A method as in claim 15, wherein the strands are of different lengths, and the strands are stacked in groupings of each of the different lengths.

17. A decorative bow as in claim 1, wherein the base member is generally flat and has a front surface to which the strands are secured and a back surface having an adhesive layer and a protective backing covering the adhesive layer.

18. A method as in claim 12, wherein the base member is generally flat and has a front surface to which the strands are secured and a back surface having an adhesive layer and a protective backing covering the adhesive layer.

* * * * *